United States Patent [19]

Nye, Jr. et al.

[11] Patent Number: 4,639,124

[45] Date of Patent: Jan. 27, 1987

[54] CLEANING SYSTEM FOR A MULTICOLOR ELECTROPHOTOGRAPHIC PRINTING MACHINE

[75] Inventors: Leroy M. Nye, Jr., Ontario; Thomas W. Pike, Rochester, both of N.Y.

[73] Assignee: Xerox Corporation, Stamford, Conn.

[21] Appl. No.: 795,947

[22] Filed: Nov. 7, 1985

[51] Int. Cl.[4] ..... G03G 21/00

[52] U.S. Cl. ..... 355/15; 355/4; 118/652

[58] Field of Search ..... 355/15, 4, 3 DD, 14 D; 118/652, 645; 430/42, 45, 125

[56] References Cited

U.S. PATENT DOCUMENTS

| | | | |
|---|---|---|---|
| 3,580,673 | 5/1971 | Yang | 355/15 |
| 3,713,736 | 1/1973 | Sargis | 355/15 |
| 3,900,003 | 8/1975 | Sato et al. | 355/10 X |
| 4,494,863 | 1/1985 | Laing | 355/15 |
| 4,571,071 | 2/1986 | Bothner | 355/15 |

*Primary Examiner*—Arthur T. Grimley
*Assistant Examiner*—J. Pendegrass
*Attorney, Agent, or Firm*—H. Fleischer; J. E. Beck; R. Zibelli

[57] ABSTRACT

An apparatus in which particles of at least two different colors are removed from a photoconductor surface. The cleaning system is controlled to remove particles of one color during one cycle of the apparatus and particles of the other color during another cycle of the apparatus. In this way, the particles of different colors are not intermingled with one another. This permits selective particles to be recycled for subsequent use in the printing machine.

21 Claims, 2 Drawing Figures

CLEANING SYSTEM FOR A MULTICOLOR ELECTROPHOTOGRAPHIC PRINTING MACHINE

Figure 1:
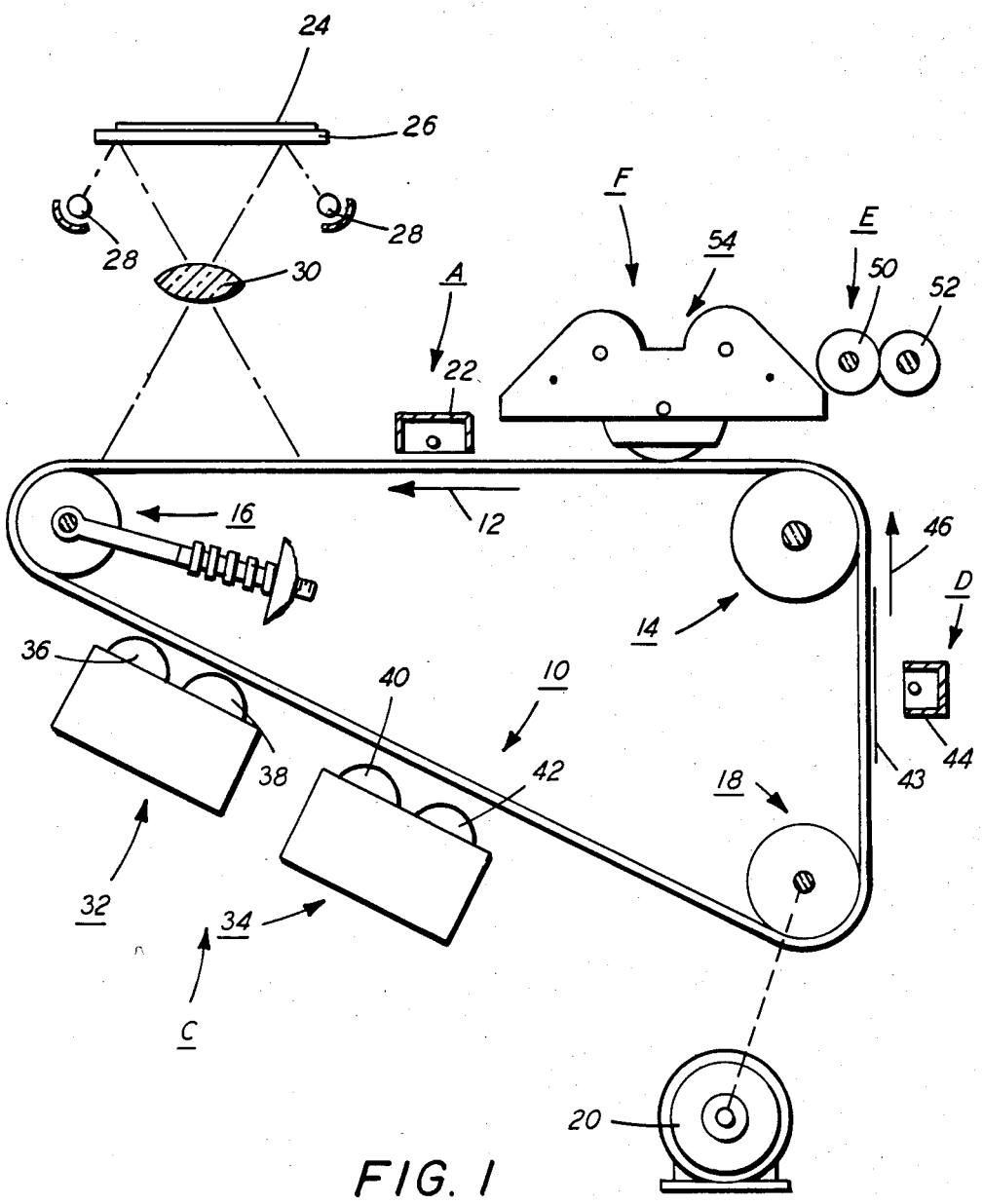

This invention relates generally to a multicolor electrophotographic printing machine, and more particularly concerns an improved cleaning system for use therein.

In electrophotographic printing, a photoconductive member is charged to sensitize the surface thereof. The charged photoconductive member is exposed to a light image of an original document being reproduced. The exposure of the sensitized photoconductive surface discharges the charge selectively. This records an electrostatic latent image on the photoconductive surface corresponding to the informational areas contained within the original document being reproduced. Development of the electrostatic latent image recorded on the photoconductive surface is achieved by bringing a developer material into contact therewith. A typical developer material comprises carrier granules having toner particles adhering triboelectrically thereto. The toner particles are attracted from the carrier granules to the latent image forming a powder image on the photoconductive surface. Thereafter, this powder image is transferred to a copy sheet and subsequently fused thereto. In multicolor electrophotographic printing, a plurality of electrostatic latent images are recorded on the photoconductive surface. Each electrostatic latent image recorded on the photoconductive surface corresponds to a color filtered optical light image of the original document. The color filtered electrostatic latent image recorded on the photoconductive surface is developed with toner particles of a color corresponding to the subtractive primary of the optically filtered light image. Alternatively, in highlight electrophotographic printing, the basic document is reproduced in one color, i.e. black, and selected portions thereof are highlighted in another color, e.g., red. In this system, the first electrostatic latent image corresponds to either the highlighted portion or the unhighlighted portion. The next electrostatic latent image corresponds to the other portion not previously recorded thereon. Thereafter, the respective electrostatic latent images are developed with black toner particles and toner particles of a selected color, e.g., red.

Frequently, it is advantageous to recycle the residual toner particles cleaned from the photoconductive surface for subsequent re-use in the printing machine. However, it has been found that the toner particles remaining on the photoconductive surface, when cleaned therefrom, intermingle with one another. Thus, the black toner particles will intermingle with the red toner particles preventing reclamation of the black toner particles. It is highly desirable to be capable of segregating the black toner particles from the red toner particles so as to be able to reclaim the black toner particles for subsequent reuse in the printing machine.

One of the more attractive methods for cleaning particles from the photoconductive surface uses a rotating magnet enclosed in a stationary, non-magnetic shell, or, alternatively, to use stationary magnets enclosed within a rotating, non-magnetic shell. This system attracts carrier granules which, in turn, attract the residual toner particles from the photoconductive surface thereto. Thus, it will be highly desirable to be capable of employing a system of this type while still being able to segregate toner particles of different colors from one another permitting reclamation thereof. Various types of cleaning systems have heretofore been employed. The following disclosures appear to be relevant:

U.S. Pat. No. 3,580,673; Patentee: Yang; Issued: May 25, 1971.

U.S. Pat. No. 3,713,736; Patentee: Sargis; Issued: Jan. 30, 1973.

The pertinent portions of the foregoing disclosure may be briefly summarized as follows:

Yang describes an apparatus for cleaning toner particles from a recording surface. The apparatus includes a rotatably mounted, nonmagnetic cylindrical member housing a permanent bar magnetic. The cylindrical member moves magnetic beads into contact with the recording surface. An electrical bias opposite in polarity to the polarity of the toner particles is applied thereto. The electrical bias is sufficient to attract the toner particles to the cleaning beads. A conductive roll is positioned in contact with the magnetic beads. The roll is electrically biased to the same polarity as the cylindrical member with the magnitude thereof being sufficient to attract the toner particles from the cleaning beads thereto.

Sargis discloses a toner removal apparatus including a container partially filled with magnetizable particles. A hollow cleaning roller is mounted therein for rotation about a permanent magnet. Toner particles clinging to the photoconductive belt are attracted by triboelectric forces to the magnetizable particles covering the surface of the cleaning roller. A pair of auxilliary rollers are disposed in the container to distribute the toner laden magnetic particles throughout the particles in the container. The cleaning roller may be electrically charged to cause the attraction of toner particles to the cleaning roller. Electrical charge may be provided by a power supply coupled to the cleaning roller.

In accordance with the features of the present invention, there is provided an apparatus for removing particles of at least two different colors from a surface. The apparatus includes means for cleaning the particles from the surface. Means are provided for controlling the cleaning means to remove the particles of one color during one cycle of the apparatus and particles of the other color during the other cycle of the apparatus without substantial intermingling of the particles of different colors with one another.

Pursuant to another aspect of the features of the present invention, there is provided an electrophotographic printing machine of the type having residual particles of one color adhering to a photoconductive member during one cycle and particles of another color adhering thereto during another cycle. Means are provided for cleaning the particles from the surface. Means control the cleaning means to remove the particles of one color during one cycle of the photoconductive member and the particles of the other color during the other cycle of the photoconductive member without substantial intermingle of the particles of different colors with one another.

Figure 2:
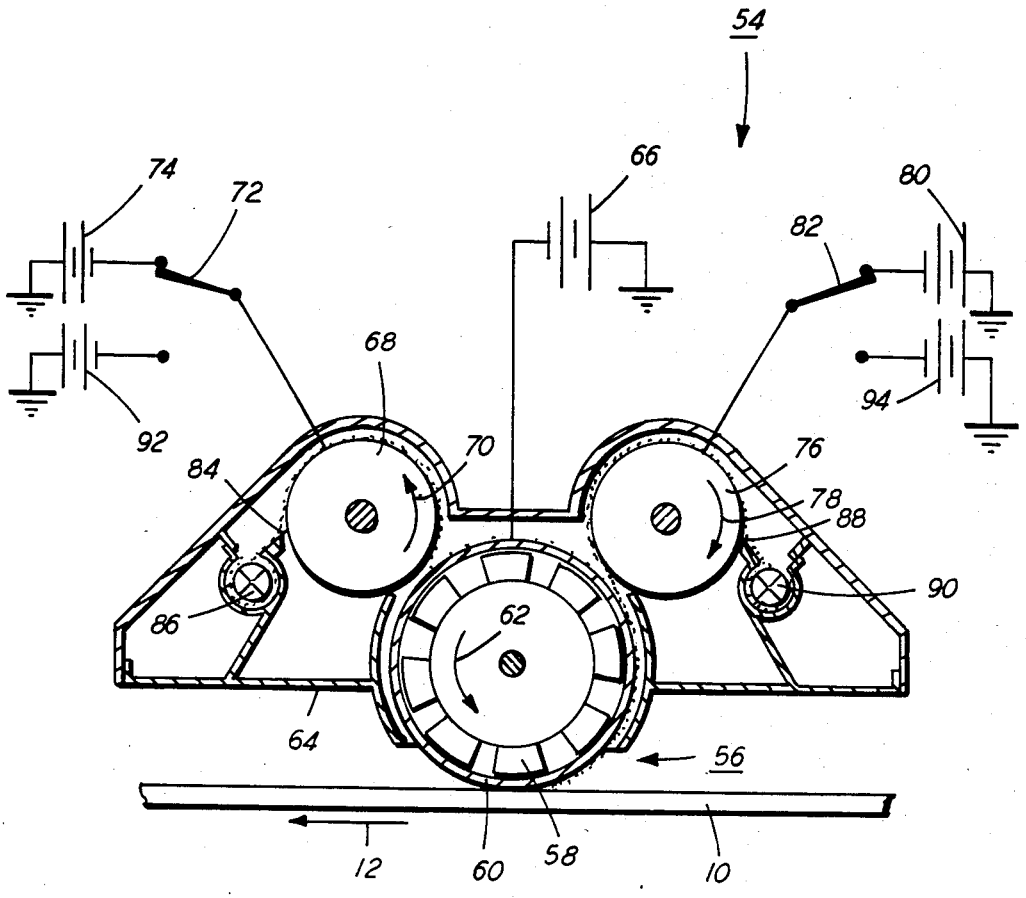

Other aspects of the present invention will become apparent as the following description proceeds and upon reference to the drawings, in which:

FIG. 1 is a schematic elevational view depicting an electrophotographic printing machine incorporating the features of the present invnetion therein; and FIG. 2 is an elevational view illustrating the cleaning system used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the illustrative electrophotographic printing machine incorporating the features of the present invention therein, reference is made to the drawings. In the drawings, like reference numerals have been used throughout the designated identifical elements. FIG. 1 schematically depicts the various components of an electrophotographic printing machine employing the cleaning system of the present invention therein. Although this cleaning system is particularly well adapted for use in the illustrative electrophotographic printing machine, it will become evident from the following discussion that it is equally well suited for use in a wide variety of electrostatographic printing machine and is not necessarily limited in its application to the particular embodiment shown therein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine is a multicolor printing machine. By this, it is meant that the electrophotographic printing is capable of producing highlight color copies. Thus, the copy will be reproduced in black and one other color, i.e. for example, red or blue. This is achieved by selectively masking the original document. Thus, for the first cycle, the original document is reproduced in black and for the second cycle only the masked area is reproduced in red or blue, i.e. the highlight color. The electrophotographic printing machine employs a belt 10 having a photoconductive surface deposited on a conductive substrate. Preferably, the photoconductive surface is made from a charge generator layer having photoconductive particles randomly dispersed in an electrically insulating organic resin. The conductive substrate comprises a charge transport layer having a transparent, electrically inactive polycarbonate resin with one or more diamines dissolved therein. Belt 10 moves in the direction of arrow 12 to advance successive portions of the photoconductive surface sequentially through the various processing stations disposed about the path of movement thereof. The path of movement of belt 10 is defined by stripping roller 14, tensioning roller 16, and drive roller 18. As depicted in FIG. 1, tensioning roller 16 is resiliently urged into contact with belt 10 so as to maintain belt 10 at the desired tension. Drive roller 18 is mounted rotatably and in engagement with belt 10. Motor 20 rotates roller 18 to advance belt 10 in the direction of arrow 12. Roller 18 is coupled to motor 20 by suitable means, such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 22, charges the photoconductive surface of belt 10 to a relatively high, substantially uniform potential.

Next, the charged portion of photoconductive surface is advanced through exposure station B. At exposure station B, the original document 24 is positioned face down upon a transparent platen 26. Lamps 28 flash light rays onto original document 24. Original document 24 is selectively masked so that only those portions being reproduced in first color, i.e. black, are visible. Thus, the electrostatic latent image being formed corresponds to the black regions of the original document. The light rays reflected from original document 24 are transmitted through lens 28 forming a light image thereof. Lens 28 focuses the light image onto the charged portion of the photoconductive surface to selectively dissipate the charge thereon. This records the first electrostatic latent image on the photoconductive surface which corresponds to the black informational areas contained within the document 24.

Thereafter, belt 10 advances the electrostatic latent image recorded on the photoconductive surface to development station C. At development station C, magnetic brush development systems, indicated generally by the reference numerals 32 and 34 advance toner particles of one color and of another color into contact with successive electrostatic latent images recorded on the photoconductive surface of belt 10. During the first cycle, development system 32 is operative and development system 34 is inoperative. Development system 32 comprises carrier granules having black toner particles adhering thereto. Development system 34 includes carrier granules having red or any other color other than black toner particles adhering thereto. Thus, during the first cycle, the black portion of the copy is being reproduced. During the next cycle, development system 32 is inoperative and development system 34 is operative. During this cycle, the masked portions of the original document correspond to the black regions with the unmasked portions corresponding to the highlighted regions. Preferably, development systems 32, and 34 each include two developer rollers 36 and 38, and 40 and 42, respectively. During the first cycle, the electrostatic latent image recorded on the photoconductive surface of belt 10 attracts the black toner particles from the carrier granules forming a black toner powder image thereon. During the next cycle, the electrostatic latent image recorded on the photoconductive surface of belt 10 attracts the highlight color toner particles, i.e. red toner particles, from the carrier granules forming a red toner powder image thereon.

After development, belt 10 advances the toner powder image to transfer station D. At transfer station D, a corona generating device 44 sprays ions onto the back side of sheet 43. This attracts the toner powder image from the photoconductive surface to sheet 43. After transfer, sheet 43 moves in the direction of arrow 46 onto a conveyor (not shown) which advances sheet 43 to fusing station E.

Fusing station E includes a fuser assembly indicated generally by the reference numeral 48, which permanently affixes the transferred toner powder image to sheet 43. Preferably, fuser assembly 48 includes a heated fuser roller 50 and a back-up roller 52. Sheet 43 passes between fuser roller 50 and back-up roller 52 with the toner powder image contacting fuser roller 50. In this manner, the toner powder image is permanently affixed to sheet 43. After fusing, the black toner particles to sheet 4, sheet 43 is recirculated back to transfer station D in a timed sequence so that the highlight color toner particles may be transferred thereto. Thus, the highlight color toner particles are transferred to sheet 43 in the region left void thereon. Thereafter, sheet 43 once again passes through fusing station E where the highlight color toner particles are permanently affixed thereto.

Invariably, after the sheet of support material is separated from the photoconductive surface of belt 10, residual particles remain adhering thereto. These residual toner particles are initially black during the first cycle and correspond in color to that of the highlight color toner particles in the second cycle. Thus, during the second cycle, the toner particles remaining on the photoconductive surface of belt 10 are red, or any other color. It is highly desirable to be capable of cleaning both the red and black toner particles from the photoconductive surface without comingling of these particles. Only in this manner, may one or both of the toner particles be reclaimed for subsequent reuse in the printing machine. These particles, both the red and black toner particles, are cleaned from the photoconductive surface of belt 10 at cleaning station F. Preferably, cleaning station F includes a cleaning system, indicated generally by the reference numeral 54, which attracts toner particles from the photoconductive surface of belt 10 thereto. The detailed structure of cleaning system 54 will be described hereinafter with reference to FIG. 2. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the cleaning system of the present invention therein.

FIG. 2 depicts cleaning system 54 in greater detail. As shown thereat, cleaning system 54 includes a cleaning roller, indicated generally by the reference numeral 56. Cleaning roller 56 includes a cylindrical magnetic roll 58 having a plurality of magnetic poles disposed about the circumferential surface thereof. A non-magnetic, conductive tubular member 60 is interfit over magnet 58. The interior circumferential surface of tubular member 60 is spaced from magnet 58. Tubular member 60 is mounted rotatably. A constant speed motor rotates tubular member 60 at a substantially constant angular velocity. Preferably, magnet 58 is made from a combination of ceramic and rubber magnets with tubular member 60 being made from aluminum. Magnet 58 is mounted fixedly and remains substantially stationary as tube 60 rotates in the direction of arrow 62. As tube 60 rotates, in the direction of arrow 62, it passes through magnetic particles disposed in housing 64. These magnetic particles are attracted to tube 60. A voltage source 66 is electrically connected to tube 60 and applies a d.c. electrical field thereto. Preferably, the polarity of this field is opposite to that of the toner particles adhering to the photoconductive surface of belt 10 and of a magnitude sufficient to attract the toner particles from the photoconductive surface to the magnetic particles adhering to tube 60. The magnetic particles are selected so that the toner particles have a triboelectric affinity thereto. Inasmuch as the toner particles are of a positive polarity, voltage source 66 electrically biases tube 60 to a voltage level of about −200 volts. As tube 60 rotates at a constant angular velocity, a brush of cleaning material is formed on the peripheral surface thereof. The brush of cleaning material advances into contact with belt 10 in the cleaning zone. The toner particles adhering to the photoconductive surface of belt 10 are attracted to the magnetic particles adhering to tube 60. In this way, the magnetic particles i.e. the cleaning material, remove the residual toner particles adhering to the photoconductive surface of belt 10.

One skilled in the art will appreciate that cleaning roller 56 need not necessarily be magnetic or require clean material to attract the residual toner particles thereto. For example, cleaning roller 56 may be an electrostatic brush cleaner using a conductive fiber brush made from a conductive Nylon, a trademark of the DuPont Corporation, which is electrically biased to a suitable magnitude and polarity.

Roller 68 is positioned closely adjacent to tube 60. As roller 68 rotates in the direction of arrow 70, it attracts the toner particles from the magnetic particles adhering to tube 60. Thus, when the black toner particles are being developed on the photoconductive surface, the residual toner particles adhering thereto are black. It is desirable to reclaim these toner particles for subsequent use in the printing machine. Under these circumstances, switch 72 electrically connects roller 68 to voltage source 74. Voltage source 74 electrically biases roller 68 to about −350 volts. The magnitude of electrical bias applied by voltage source 74 to roller 68 is greater than the electrical bias applied by voltage source 66 to tube 60. Thus, the toner particles are attracted to roller 68 from the cleaning material adhering to tube 60. Simultaneously therewith, roller 76, which rotates in the direction of arrow 78 and is also positioned closely adjacent to tubular member 60, is electrically biased by voltage source 80. This is achieved by switch 82 coupling voltage source 80 to roller 76. Voltage source 80 electrically biases roller 76 to about −100 volts. This electrical bias is insufficient to attract the toner particles from the cleaning material on tubular member 60 thereto. However, this electrical bias is sufficient to attract any charged paper debris and wrongly signed, i.e., negatively charged toner particles, from the cleaning material adhering to the tubular member 60. Thus, during this cycle of operation wherein the electrostatic latent image recorded on photoconductive member 10 is developed with black toner particles, residual black toner particles are removed therefrom by the cleaning material adhering to tubular member 60. Thereafter, these residual black toner particles are removed from the cleaning material by roller 68. A metering blade 84 is located closely adjacent to roller 68 for removing the toner particles therefrom. Metering blade 84 deflects or shears the black toner particles from roller 68 into a helical auger 86. Helical auger 86 advances these residual black toner particles to a remote location for subsequent reuse in the printing machine development system. By way of example, these black toner particles may be augered directly back to the sump or chamber of the housing of development system 32 for reuse therein. Similarly, a metering blade 88 is located closely adjacent to roller 76 for removing negatively charged paper debris and wrongly signed toner adhering to roller 76. Metering blade 88 deflects or shears the toner particles and paper debris from roller 76 into a helical auger 90. Helical auger 90 advances these toner particles and paper debris to a remote location for subsequent removal from the printing machine.

During the second cycle, when the highlight color toner particles are being developed on the electrostatic latent image corresponding to the highlight regions of the copy, the residual red or highlight color toner particles must be removed from the photoconductive surface of belt 10. This is accomplished by switch 72 coupling voltage source 92 to roller 68. Voltage source 92 electrically biases roller 68 to about a −200 volts. Thus, roller 68 and tubular member 60 are electrically biased to substantially the same voltage. Under these circumstances, toner particles will not be attracted to roller 68. The highlight color toner particles adhering to the cleaning material on tubular member 60 remain thereon and are not attracted to roller 68. However, switch 82 now couples voltage source 94 to roller 76. Voltage source 94 electrically biases roller 78 to a −350 volts. Now, the residual highlight color toner particles, i.e. the red toner particles, adhering to the cleaning material on tubular member 60 are attracted to roller 76. Once again, metering blade 88 shears the highlight color toner particles from roller 76 into helical auger 90. Helical auger 90 advances the highlight color toner particles to a remote location wherein a discard bottle is located. Thus, it is seen that the function of roller 68 is to remove only black toner particles that are subsequently advanced to a remote location for reclamation or immediate reuse in the printing machine. In contradistinction, roller 76 has a dual function. One of its functions is to remove wrongly signed toner particles and paper debris while its other function is to remove highlight color toner particles. All of the foregoing material is transported by auger 90 to a remote location wherein they are discharged into a discard bottle. Thus, the red toner particles, the paper debris, and the wrongly signed black toner particles are transported to a common location for discharge into a discard bottle. The foregoing prevents the intermingling of black toner particles with the highlight color toner particles. Only in this way, may the black toner particles be readily reclaimed for subsequent reuse in the printing machine without intermingling with the red toner particles.

In recapitulation, it is clear that the cleaning system of the present invention includes a cleaning roller positioned closely adjacent to the photoconductive surface of a belt so as to remove toner particles therefrom. A pair of rollers are postiioned closely adjacent to the cleaning roller. One of the rollers is dedicated to removing black toner particles which are subsequently reclaimed for further use in the printing machine with the other roller being dedicated to removing the highlight color toner particles, as well as wrongly charged black toner particles and paper debris. This prevents the intermingling of the black toner particles with the highlight color toner particle.

We claim:

1. An apparatus for removing particles of at least two different colors from a surface during two operating cycles, including:

a particle removing member;

first means for attracting the particles of one color from said removing member thereto;

second means for attracting the particles of the other color from said removing member thereto; and means for electrically biasing said first attracting means and said second attracting means to a plurality of voltage levels with said first attracting means being electrically biased to a voltage level so as to attract the particles of one color from said removing member thereto during one cycle of the apparatus with said second attracting means being electrically biased to a voltage level so that substantially no particles are attracted thereto, and said second attracting means being electrically biased to a voltage level so as to attract particles of the other color from said removing member thereto during the other cycle of the apparatus with said first attracting means being electrically biased to a voltage level so that substantially no particles are attracted thereto.

2. An apparatus according to claim 1 wherein said removing member includes:

a rotatably mounted tubular member; and means for attracting a cleaning material to said tubular member.

3. An apparatus according to claim 2, wherein:

said first attracting means includes a first roller coupled electrically to said biasing means; and said second attracting means includes a second roller, spaced from said first roller, electrically coupled to said biasing means.

4. An apparatus according to claim 3, further including means for transporting the particles attracted to said first roller and said second roller to a location remote therefrom.

5. An apparatus according to claim 4, wherein said transporting means includes:

a first auger positioned adjacent said first roller for transporting the particles from said first roller to the remote location; and a second auger positioned adjacent said second roller for transporting the particles from said second roller to the remote location.

6. An apparatus according to claim 5, wherein the cleaning material includes magnetic particles.

7. An apparatus according to claim 6, wherein said attracting means includes an elongated magnetic member disposed interiorly of and spaced from said tubular member.

8. An apparatus according to claim 3, wherein said biasing means includes:

a first voltage source arranged to electrically bias said first roller to a voltage level so as to attract particles from the cleaning material on said tubular member thereto;

a second voltage source arranged to electrically bias said first roller to a voltage level so that substantially no particles are attracted from the cleaning material on said tubular member thereto; and first means for switching from said first voltage source during one cycle of the apparatus to said second voltage source during the other cycle of the apparatus.

9. An apparatus according to claim 8, wherein said biasing means includes:

a third voltage source arranged to electrically bias said second roller to a voltage level so as to attract particles from the cleaning material on said tubular member thereto;

a fourth voltage source arranged to electrically bias said second roller to a voltage level so that substantially no particles are attracted from the cleaning material on said tubular member thereto; and second means for switching from said fourth voltage source during one cycle of the apparatus to said third voltage source during the other cycle of the apparatus.

10. An electrophotographic printing machine of the type having residual particles of one color adhering to a photoconductive member during one cycle and particles of a different color adhering thereto during another cycle thereof, wherein the improvement includes:

a particle removing member;

first means for attracting the particles of one color from said removing member thereto;

second means for attracting the particles of the other color from said removing member thereto; and means for electrically biasing said first attracting means and said second attracting means to a plurality of voltage levels with said first attracting means being electrically biased to a voltage level so as to attract the particles of one color from said removing member during one cycle of the apparatus with said second attracting means being electrically biased to a voltage level so that substantially no particles are attracted thereto, and said second attracting means being electrically biased to a voltage level so as to attract particles of the other color from said removing member during the other cycle of the apparatus with said first attracting means being electrically biased to a voltage level so that substantially no particles are attracted thereto.

11. A printing machine according to claim 10 wherein said removing member includes:

a rotatably mounted tubular member; and means for attracting a cleaning material to said tubular member.

12. A printing machine according to claim 11, wherein:

said first attracting means includes a first roller coupled electrically to said biasing means; and said second attracting means includes a second roller, spaced from said first roller, coupled electrically to said biasing means.

13. A printing machine according to claim 12 further including means for transporting the particles attracted to said first roller and said second roller to a location remote therefrom.

14. A printing machine acording to claim 13 wherein said transporting means includes:

a first auger positioned adjacent said first roller for transporting the particles from said first roller to the remote location; and a second auger positioned adjacent said second roller for transporting the particles from said second roller to the remote location.

15. A printing machine according to claim 14 further including a waste container, positioned at the remote location, for receiving the particles transported to the remote location transported thereto from said first roller by said transporting means.

16. A printing machine according to claim 15, further including:

means for recording electrostatic latent images on the photoconductive member; and means for developing the latent images with particles of the one color during one cycle of the photoconductive member and particles of the other color during the other cycle of the photoconductive member.

17. A printing machine according to claim 16 wherein said transporting means transports the particles from the second roller to said developing means.

18. A printing machine according to claim 17, wherein the cleaning material includes magnetic particles.

19. A printing machine according to claim 18, wherein said attracting means includes an elongated magnetic member disposed interiorly of and spaced from said tubular member.

20. A printing machine according to claim 12, wherein said biasing means includes:

a first voltage source arranged to electrically bias said first roller to a voltage level so as to attract particles from the cleaning material on said tubular member thereto;

a second voltage source arranged to electrically bias said first roller to a voltage level so that substantially no particles are attracted from the cleaning material on said tubular member thereto; and first means for switching from said first voltage source during one cycle of the photoconductive member to said second voltage source during the other cycle of the photoconductive member.

21. A printing machine according to claim 20, wherein said biasing means includes:

a third voltage source arranged to electrically bias said second roller to a voltage level so as to attract particles from the cleaning material on said tubular member thereto;

a fourth voltage source arranged to electrically bias said second roller to a voltage level so that substantially no particles are attracted from the cleaning material on said tubular member thereto; and second means for switching from said fourth voltage source during one cycle of the photoconductive member to said third voltage source during the other cycle of the photoconductive member.

* * * * *